US009777897B2

(12) United States Patent
Pickard et al.

(10) Patent No.: US 9,777,897 B2
(45) Date of Patent: Oct. 3, 2017

(54) MULTIPLE PANEL TROFFER-STYLE FIXTURE

(75) Inventors: Paul Kenneth Pickard, Morrisville, NC (US); Mark D. Edmond, Raleigh, NC (US); Gerald Negley, Chapel Hill, NC (US); Eric Tarsa, Goleta, CA (US)

(73) Assignee: CREE, INC., Durham, NC (US)

( * ) Notice: Subject to any disclaimer, the term of this patent is extended or adjusted under 35 U.S.C. 154(b) by 423 days.

(21) Appl. No.: 13/368,217

(22) Filed: Feb. 7, 2012

(65) Prior Publication Data

US 2013/0201670 A1 Aug. 8, 2013

(51) Int. Cl.

| | |
|---|---|
| ***F21V 1/00*** | (2006.01) |
| ***F21V 11/00*** | (2015.01) |
| ***F21S 8/02*** | (2006.01) |
| ***F21V 5/00*** | (2015.01) |
| ***F21V 5/02*** | (2006.01) |
| ***F21V 23/02*** | (2006.01) |
| *F21Y 103/10* | (2016.01) |
| *F21Y 115/10* | (2016.01) |
| *F21Y 105/16* | (2016.01) |

(52) U.S. Cl.

CPC ..... *F21S 8/026* (2013.01); *F21V 5/002* (2013.01); *F21V 5/02* (2013.01); *F21V 23/02* (2013.01); *F21Y 2103/10* (2016.08); *F21Y 2105/16* (2016.08); *F21Y 2115/10* (2016.08)

(58) Field of Classification Search

CPC ..... F21Y 2105/00

USPC ..... 362/612, 613, 615, 616, 240, 249.02, 362/249.06, 382, 404, 147

See application file for complete search history.

(56) References Cited

U.S. PATENT DOCUMENTS

| | | | | |
|---|---|---|---|---|
| D85,382 | S | 10/1931 | Guth | D26/24 |
| 2,356,654 | A | 8/1944 | Cullman | 200/84 C |
| 3,381,124 | A | 4/1968 | Eisenberg | 362/354 |
| 3,743,826 | A | 7/1973 | Halfaker | |
| 4,939,627 | A | 7/1990 | Herst et al. | 362/299 |

(Continued)

FOREIGN PATENT DOCUMENTS

| | | |
|---|---|---|
| CN | 1762061 | 4/2006 |
| CN | 1934389 | 3/2007 |

(Continued)

OTHER PUBLICATIONS

International Search Report and Written Opinion for Patent Application No. PCT/US2011/001517, dated: Feb. 27, 2012.

(Continued)

*Primary Examiner* — Tsion Tumebo

(74) *Attorney, Agent, or Firm* — Koppel, Patrick, Heybl & Philpott

(57) ABSTRACT

Lighting fixtures are described utilizing a plurality of light sources, or light engines, which are mounted together in a modular fashion in the light fixture opening. In some embodiments, the plurality of light sources can comprise lighting panels that together form the overall fixture light source. The present invention is particularly applicable to troffer-style lighting fixtures that can be arranged with a plurality of lighting panels arranged in the troffer opening to illuminate the space below the troffer. Embodiments of the present invention can also utilize solid state light sources for the lighting panels, with some embodiments utilizing light emitting diodes (LEDs).

48 Claims, 5 Drawing Sheets

(56) References Cited

U.S. PATENT DOCUMENTS 5,025,356 A 6/1991 Gawad ..... 362/221
5,526,190 A 6/1996 Hubble, III ..... 347/102
5,823,663 A 10/1998 Bell et al. ..... 362/362
D407,473 S 3/1999 Wimbock ..... D23/328
6,079,851 A 6/2000 Altman
6,102,550 A 8/2000 Edwards, Jr.
6,149,283 A 11/2000 Conway et al. ..... 362/236
6,155,699 A 12/2000 Miller et al. ..... 362/293
6,210,025 B1 4/2001 Schmidt et al. ..... 362/362
6,234,643 B1 5/2001 Lichon, Jr. ..... 362/147
6,402,347 B1 6/2002 Maas et al. ..... 362/294
6,443,598 B1 9/2002 Morgan ..... 362/342
6,523,974 B2 2/2003 Engel ..... 362/224
6,578,979 B2 6/2003 Truttmann-Battig ..... 362/92
6,598,998 B2 7/2003 West ..... 257/E33.073
D496,121 S 9/2004 Santoro ..... D26/74
6,871,983 B2 3/2005 Jacob et al. ..... 362/364
6,948,838 B2 9/2005 Kunstler ..... 362/237
6,948,840 B2 9/2005 Grenda et al. ..... 362/555
6,951,415 B2 10/2005 Amano ..... 362/297
7,021,797 B2 4/2006 Minano et al. ..... 362/355
7,049,761 B2 5/2006 Timmermans et al. ..... 315/246
7,063,449 B2 * 6/2006 Ward ..... G02B 6/0048 345/102
7,111,969 B2 9/2006 Bottesch ..... 362/299
7,175,296 B2 * 2/2007 Cok ..... E04B 9/003 362/147
7,213,940 B1 5/2007 Van de Ven et al. ..... 362/231
7,217,004 B2 5/2007 Park ..... 362/240
7,237,924 B2 7/2007 Martineau et al. ..... 362/231
D556,358 S 11/2007 Santoro ..... D26/74
7,338,182 B1 3/2008 Hastings et al. ..... 362/150
7,341,358 B2 3/2008 Hsieh ..... 362/97.1
7,510,299 B2 3/2009 Timmermans et al. ..... 362/225
7,520,636 B2 4/2009 Van der Poel ..... 362/290
D593,246 S 5/2009 Fowler et al. ..... D26/76
7,547,112 B2 * 6/2009 Kim ..... 362/148
7,559,672 B1 7/2009 Parkyn et al. ..... 362/244
7,594,736 B1 9/2009 Kassay et al. ..... 362/223
D604,446 S 11/2009 Fowler et al. ..... D26/76
7,618,157 B1 11/2009 Galvez et al. ..... 362/294
7,618,160 B2 11/2009 Chinniah et al. ..... 362/326
D608,932 S 1/2010 Castelli ..... D26/76
7,654,688 B2 2/2010 Li
7,654,702 B1 2/2010 Ding et al. ..... 362/294
7,661,844 B2 2/2010 Sekiguchi et al. ..... 362/249
D611,183 S 3/2010 Duarte ..... D26/76
7,674,005 B2 3/2010 Chung et al. ..... 362/223
7,686,470 B2 3/2010 Chiang ..... 362/147
7,686,484 B2 3/2010 Heiking et al. ..... 362/375
7,712,918 B2 5/2010 Siemiet et al. ..... 362/241
7,722,220 B2 5/2010 Van de Ven ..... 362/294
7,722,227 B2 5/2010 Zhang et al. ..... 362/364
D617,487 S 6/2010 Fowler et al. ..... D26/76
7,768,192 B2 8/2010 Van de Ven et al. ..... 313/503
7,815,338 B2 10/2010 Siemiet et al. ..... 362/218
7,824,056 B2 11/2010 Madireddi et al. ..... 362/125
7,828,468 B2 11/2010 Mayfield et al. ..... 362/342
7,868,484 B2 1/2011 Groff et al. ..... 362/375
7,874,716 B2 * 1/2011 Lai et al. ..... 362/613
D633,247 S 2/2011 Kong et al. ..... D26/88
7,901,105 B2 * 3/2011 Fowler et al. ..... 362/217.15
7,922,354 B2 4/2011 Everhart ..... 362/235
7,926,982 B2 4/2011 Liu ..... 362/294
7,954,975 B2 * 6/2011 Zhou ..... 362/147
7,959,332 B2 6/2011 Tickner
7,988,321 B2 8/2011 Wung et al. ..... 362/218
7,988,335 B2 8/2011 Liu et al. ..... 362/294
7,991,257 B1 * 8/2011 Coleman ..... B29D 11/0073 264/1.24
7,993,034 B2 8/2011 Wegner ..... 362/296.05
7,997,762 B2 8/2011 Wang et al. ..... 362/249
8,038,314 B2 10/2011 Ladewig
8,038,321 B1 10/2011 Franck et al. ..... 362/249.02
8,070,326 B2 12/2011 Lee ..... 362/307
D653,376 S 1/2012 Kong et al. ..... D26/76
8,092,043 B2 1/2012 Lin et al. ..... 362/249.02
8,092,049 B2 1/2012 Kinnune et al. ..... 362/294
8,096,671 B1 * 1/2012 Cronk ..... F21S 2/005 362/147
D657,488 S 4/2012 Lown et al. ..... D26/120
8,162,504 B2 4/2012 Zhang et al. ..... 362/217
8,186,855 B2 5/2012 Wassel et al. ..... 362/373
8,197,086 B2 6/2012 Watanabe et al. ..... 362/218
8,201,968 B2 6/2012 Maxik et al.
8,215,799 B2 7/2012 Vanden Eynden et al. .. 362/294
8,240,875 B2 * 8/2012 Roberts et al. ..... 362/217.05
8,246,219 B2 * 8/2012 Teng et al. ..... 362/311.03
8,256,927 B2 9/2012 Hu ..... 362/218
8,287,160 B2 10/2012 Shen
D670,849 S 11/2012 Lay et al. ..... D26/74
8,317,354 B2 11/2012 Gassner et al. ..... 362/147
D676,848 S 2/2013 Smith et al. ..... D26/74
8,410,514 B2 * 4/2013 Kim ..... H01L 25/167 257/99
8,451,256 B2 * 5/2013 Kim et al. ..... 345/204
D684,291 S 6/2013 Goelz et al. ..... D26/74
8,480,252 B2 7/2013 Bertram et al. ..... 362/243
8,506,135 B1 8/2013 Oster ..... 362/373
8,556,452 B2 10/2013 Simon ..... 362/217.07
8,591,058 B2 11/2013 Concepcion ..... 362/231
8,591,071 B2 11/2013 Hochstein ..... 362/294
8,602,601 B2 12/2013 Khazi
8,604,712 B2 * 12/2013 Bloom et al. ..... 315/294
8,616,723 B2 12/2013 Zhang ..... 362/218
8,632,236 B2 * 1/2014 Urtiga ..... 362/612
D698,975 S 2/2014 Blessitt et al. ..... D26/74
8,641,243 B1 2/2014 Rashidi ..... 362/373
D701,988 S 4/2014 Clements ..... D26/74
8,696,154 B2 4/2014 Hutchens ..... 362/217.05
8,702,264 B1 4/2014 Rashidi ..... 362/147
8,721,151 B2 * 5/2014 Wang et al. ..... 362/616
8,764,226 B2 * 7/2014 Roberts et al. ..... 362/232
8,764,244 B2 7/2014 Jeon ..... 362/218
D714,988 S 10/2014 Park et al. ..... D26/74
D721,198 S 1/2015 Glasbrenner ..... D26/76
9,010,956 B1 4/2015 Davis
9,052,075 B2 6/2015 Demuynck et al.
2003/0063476 A1 4/2003 English et al.
2004/0001344 A1 1/2004 Hecht ..... 362/555
2004/0085779 A1 5/2004 Pond et al. ..... 362/516
2004/0100796 A1 5/2004 Ward
2004/0240230 A1 * 12/2004 Kitajima ..... F21S 8/032 362/558
2005/0180135 A1 8/2005 Mayer ..... 362/240
2005/0264716 A1 12/2005 Kim et al.
2005/0281023 A1 12/2005 Gould ..... 362/217
2006/0221611 A1 10/2006 Noh ..... 362/247
2006/0262521 A1 11/2006 Piepgras et al. ..... 362/149
2006/0291206 A1 12/2006 Angelini et al. ..... 362/244
2007/0070625 A1 3/2007 Bang ..... 362/240
2007/0109779 A1 5/2007 Sekiguchi et al.
2007/0115670 A1 5/2007 Roberts et al.
2007/0115671 A1 5/2007 Roberts et al.
2007/0133193 A1 * 6/2007 Kim ..... 362/147
2007/0211457 A1 9/2007 Mayfield et al. ..... 362/223
2007/0247896 A1 * 10/2007 Bhavnagarwala et al. ... 365/154
2007/0253205 A1 11/2007 Welker ..... 362/373
2007/0297181 A1 12/2007 Mayfield et al. ..... 362/342
2008/0019147 A1 * 1/2008 Erchak ..... G01J 1/32 362/607
2008/0037284 A1 * 2/2008 Rudisill ..... F21S 2/005 362/629
2008/0049422 A1 2/2008 Trenchard et al. ..... 362/238
2008/0232093 A1 * 9/2008 Kim ..... 362/147
2008/0278943 A1 11/2008 Van Der Poel ..... 362/240
2009/0034247 A1 2/2009 Boyer ..... 362/225
2009/0073693 A1 * 3/2009 Nall ..... G09F 13/04 362/249.02
2009/0161356 A1 6/2009 Negley et al. ..... 362/231
2009/0168439 A1 7/2009 Chiang ..... 362/404
2009/0196024 A1 8/2009 Heiking et al. ..... 362/150
2009/0225543 A1 9/2009 Roberts et al.
2009/0237958 A1 9/2009 Kim

(56) References Cited

U.S. PATENT DOCUMENTS

| | | | | |
|---|---|---|---|---|
| 2009/0262543 | A1 | 10/2009 | Ho | 362/373 |
| 2009/0296388 | A1 | 12/2009 | Wu et al. | 362/235 |
| 2009/0310354 | A1 | 12/2009 | Zampini et al. | 362/235 |
| 2009/0323334 | A1 | 12/2009 | Roberts et al. | |
| 2010/0061108 | A1 | 3/2010 | Zhang et al. | 362/364 |
| 2010/0097794 | A1 | 4/2010 | Teng et al. | 362/231 |
| 2010/0103678 | A1 | 4/2010 | Van de Ven et al. | 362/294 |
| 2010/0110679 | A1 | 5/2010 | Teng et al. | |
| 2010/0172133 | A1 | 7/2010 | Liu | 362/235 |
| 2010/0177532 | A1 | 7/2010 | Simon et al. | |
| 2010/0188609 | A1 | 7/2010 | Matsuki et al. | |
| 2010/0253591 | A1 | 10/2010 | Hwu et al. | 345/1.3 |
| 2010/0254121 | A1* | 10/2010 | Zhou | 362/147 |
| 2010/0254128 | A1 | 10/2010 | Pickard et al. | 362/231 |
| 2010/0254145 | A1 | 10/2010 | Yamaguchi | |
| 2010/0254146 | A1 | 10/2010 | McCanless | |
| 2010/0270903 | A1 | 10/2010 | Jao et al. | 313/46 |
| 2010/0271843 | A1 | 10/2010 | Holten et al. | 362/609 |
| 2010/0277905 | A1 | 11/2010 | Janik et al. | 362/235 |
| 2010/0277934 | A1 | 11/2010 | Oquendo, Jr. | 362/433 |
| 2010/0295468 | A1 | 11/2010 | Pedersen et al. | 315/294 |
| 2010/0302778 | A1 | 12/2010 | Dabiet | |
| 2010/0327768 | A1 | 12/2010 | Kong et al. | 315/294 |
| 2011/0013421 | A1* | 1/2011 | Um | 362/612 |
| 2011/0032714 | A1 | 2/2011 | Chang | 362/373 |
| 2011/0043132 | A1 | 2/2011 | Kim et al. | 362/235 |
| 2011/0090671 | A1 | 4/2011 | Bertram et al. | 362/84 |
| 2011/0141722 | A1 | 6/2011 | Acampora et al. | 362/218 |
| 2011/0141734 | A1 | 6/2011 | Li | 362/235 |
| 2011/0156584 | A1 | 6/2011 | Kim | 315/32 |
| 2011/0164417 | A1 | 7/2011 | Huang | 362/235 |
| 2011/0175533 | A1* | 7/2011 | Holman | E04B 9/32 315/130 |
| 2011/0199005 | A1 | 8/2011 | Bretschneider et al. | |
| 2011/0199769 | A1 | 8/2011 | Bretschneider et al. | |
| 2011/0246146 | A1 | 10/2011 | Kauffman et al. | 703/2 |
| 2011/0255292 | A1 | 10/2011 | Shen | 362/311 |
| 2011/0267810 | A1 | 11/2011 | Higman et al. | 362/218 |
| 2011/0267823 | A1 | 11/2011 | Angelini et al. | 362/277 |
| 2011/0286225 | A1 | 11/2011 | Konishi | |
| 2011/0305024 | A1 | 12/2011 | Chang | 362/294 |
| 2011/0310603 | A1* | 12/2011 | Simons | 362/235 |
| 2012/0033420 | A1 | 2/2012 | Kim et al. | 362/235 |
| 2012/0038289 | A1 | 2/2012 | Jee et al. | 315/291 |
| 2012/0051041 | A1 | 3/2012 | Edmond et al. | 362/231 |
| 2012/0120658 | A1 | 5/2012 | Wilk | |
| 2012/0127714 | A1 | 5/2012 | Rehn | |
| 2012/0134146 | A1 | 5/2012 | Smith | 362/225 |
| 2012/0140442 | A1 | 6/2012 | Woo | 362/95 |
| 2012/0140461 | A1 | 6/2012 | Pickard | |
| 2012/0206926 | A9 | 8/2012 | Chou | |
| 2013/0235568 | A1 | 9/2013 | Green et al. | 362/218 |
| 2013/0242550 | A1 | 9/2013 | Suen | |
| 2013/0258652 | A1 | 10/2013 | Hsieh | 362/225 |
| 2013/0265751 | A1* | 10/2013 | Edmond et al. | 362/231 |
| 2014/0265930 | A1 | 9/2014 | Harris | 315/307 |
| 2015/0016100 | A1 | 1/2015 | Ishii | 362/223 |

FOREIGN PATENT DOCUMENTS

| | | | |
|---|---|---|---|
| CN | 1963289 | A | 5/2007 |
| CN | 101188261 | | 5/2008 |
| CN | 101660715 | | 3/2010 |
| CN | 101776254 | | 7/2010 |
| CN | 101776254 | A | 7/2010 |
| CN | 101790660 | | 7/2010 |
| CN | 101790660 | A | 7/2010 |
| CN | 102072443 | | 5/2011 |
| CN | 202580962 | | 12/2012 |
| DE | 102007030186 | | 1/2009 |
| DE | 202010001832 | | 7/2010 |
| EP | 1298383 | A2 | 4/2003 |
| EP | 1357335 | A2 | 10/2003 |
| EP | 1653254 | | 3/2006 |
| EP | 1737051 | | 12/2006 |
| EP | 1847762 | A2 | 10/2007 |
| EP | 1860467 | | 11/2007 |
| EP | 2287520 | A2 | 2/2011 |
| EP | 2636945 | A2 | 11/2013 |
| GB | 774198 | | 8/1957 |
| JP | 1069809 | | 3/1998 |
| JP | 2002244027 | | 11/2002 |
| JP | U3097327 | | 8/2003 |
| JP | 2004140327 | | 5/2004 |
| JP | 2004345615 | | 12/2004 |
| JP | 2004345615 | A | 12/2004 |
| JP | 2006173624 | | 6/2006 |
| JP | 2008147044 | | 6/2008 |
| JP | 3151501 | U | 6/2009 |
| JP | 2009295577 | | 12/2009 |
| JP | 2010103687 | | 5/2010 |
| JP | 2011018571 | | 8/2011 |
| JP | 2011018572 | | 8/2011 |
| TW | 200524186 | | 7/2005 |
| TW | 200524186 | A | 7/2005 |
| TW | 200914759 | A | 4/2009 |
| TW | 201018826 | | 5/2010 |
| TW | 201018826 | A | 5/2010 |
| WO | WO03102467 | | 12/2003 |
| WO | WO2009030233 | | 3/2009 |
| WO | WO2009140761 | A1 | 11/2009 |
| WO | WO2009157999 | | 12/2009 |
| WO | WO2009157999 | A | 12/2009 |
| WO | WO2009157999 | A1 | 12/2009 |
| WO | WO2010024583 | | 3/2010 |
| WO | WO2010024583 | A2 | 3/2010 |
| WO | WO2010042216 | | 4/2010 |
| WO | WO2010042216 | A2 | 4/2010 |
| WO | WO2011074424 | A1 | 6/2011 |
| WO | WO2011096098 | A1 | 8/2011 |
| WO | WO2011098191 | | 8/2011 |
| WO | WO2011118991 | A2 | 9/2011 |
| WO | WO2011140353 | A2 | 11/2011 |

OTHER PUBLICATIONS

Office Action from U.S. Appl. No. 13/429,080, dated Apr. 18, 2014.
Office Action from U.S. Appl. No. 12/961,385, dated Mar. 11, 2014.
Office Action from Japanese Design Patent Application No. 2011-18570.
Reason for Rejection from Japanese Design Patent Application No. 2011-18571.
Reason for Rejection from Japanese Design Patent Application No. 2011-18572.
International Search Report and Written Opinion from PCT Application No. PCT/US2013/021053, dated Apr. 17, 2013.
Notice to Submit a Response from Korean Patent Application No. 30-2011-0038115, dated Dec. 12, 2012.
Notice to Submit a Response from Korean Patent Application No. 30-2011-0038116, dated Dec. 12, 2012.
U.S. Appl. No. 12/873,303, filed Aug. 31, 2010 to Edmond, et al.
Cree's XLamp XP-E LED's, data sheet, pp. 1-16.
Cree's XLamp XP-G LED's, data sheet, pp. 1-12.
International Search Report and Written Opinion from Appl. No. PCT/CN2013/072772, dated Dec. 19, 2013.
Reasons for Rejection from Japanese Patent Appl. No. 2013-543207, dated May 20, 2014.
First Office Action from Chinese Patent Appl. No. 2011800529984, dated May 4, 2014.
Office Action from U.S. Appl. No. 13/544,662, dated May 5, 2114.
Office Action from U.S. Appl. No. 13/844,431, dated May 15, 2014.
Office Action from U.S. Appl. No. 13/341,741, dated Jun. 6, 2014.
Final Rejection issued in Korean Design Appl. No. 30-2011-0038114, dated Jun. 14, 2013.
Final Rejection issued in Korean Design Appl. No. 30-2011-0038115, dated Jun. 14, 2013.
Final Rejection issued in Korean Design Appl. No. 30-2011-0038116, dated Jun. 17, 2013.
International Search Report and Written Opinion from PCT Patent Appl. No. PCT/US2013/035668, dated Jul. 12, 2013.

(56) References Cited

OTHER PUBLICATIONS

International Search Report and Written Opinion for PCT Application No. PCT/US2011/062396, dated Jul. 13, 2012.
International Preliminary Report on Patentabiliby from PCT/US2012/071800 dated Jul. 10, 2014.
Office Action from U.S. Appl. No. 13/189,535, dated Jun. 20, 2014.
Office Action from U.S. Appl. No. 13/453,924, dated Jun. 25, 2014.
Office Action from U.S. Appl. No. 13/443,630, dated Jul. 1, 2014.
Office Action from U.S. Appl. No. 13/464,745, dated Jul. 16, 2014.
International Preliminary Report on Patentability and Written Opinion from PCT/US2013/021053, dated Aug. 21, 2014.
Office Action from U.S. Appl. No. 29/387,171, dated May 2, 2012.
Response to OA from U.S. Appl. No. 29/387,171, filed Aug. 2, 2012.
Office Action from U.S. Appl. No. 12/961,385, dated Apr. 26, 2013.
Response to OA from U.S. Appl. No. 12/961,385, filed Jul. 24, 2013.
Office Action from U.S. Appl. No. 13/464,745, dated Jul. 16, 2013.
Office Action from U.S. Appl. No. 29/368,970, dated Jun. 19, 2012.
Office Action from U.S. Appl. No. 29/368,970, dated Aug. 24, 2012.
Response to OA from U.S. Appl. No. 29/368,970, filed Nov. 26, 2012.
International Search Report and Written Opinion from PCT/US2013/049225, dated Oct. 24, 2013.
Search Report and Written Opinion from PCT Patent Appl. No. PCT/US2012/047084, dated Feb. 27, 2013.
Search Report and Written Opinion from PCT Patent Appl. No. PCT/US2012/071800, dated Mar. 25, 2013.
Preliminary Report and Written Opinion from PCT appl. No. PCT/US2012/047084, dated Feb. 6, 2014.
Office Action from U.S. Appl. No. 13/464,745, dated Feb. 12, 2014.
Office Action from U.S. Appl. No. 13/453,924, dated Feb. 19, 2014.
Office Action from U.S. Appl. No. 13/341,741, dated Jan. 14, 2014.
Office Action from U.S. Appl. No. 13/370,252, dated Dec. 20, 2013.
First Official Action from European Patent Appl. No. 12 743 003.1-1757, dated Jan. 16, 2015.
Office Action from U.S. Appl. No. 13/787,727, dated Jan. 29, 2015.
Office Action from U.S. Appl. No. 13/429,080, dated Feb. 18, 2015.
Office Action from U.S. Appl. No. 13/453,924, dated Mar. 10, 2015.
Grant Notice from European Appl. No. 13711525.1, dated Nov. 19, 2014.
Second Office Action and Search Report from Chinese Appl. No 2011800529984, dated Dec. 26, 2014.
International Report and Written Opinion from PCT/US2013/049225, dated Jan. 22, 2015.
Office Action from U.S. Appl. No. 13/828,348, dated Nov. 20, 2014.
Office Action from U.S. Appl. No. 12/873,303, dated Nov. 28, 2014.
Office Action from U.S. Appl. No. 13/464,745, dated Dec. 10, 2014.
Office Action from U.S. Appl. No. 13/341,741, dated Dec. 24, 2014.
Office Action from U.S. Appl. No. 13/185,535, dated Jan. 13, 2015.
Communication from European Patent Appl. No. 13701525.1-1757, dated Sep. 26, 2014.
Decision of Rejection from Japanese Appl. No. 2013-543207, dated Nov. 25, 2014.
Office Action from Mexican Appl. No. 100881, dated Nov. 28, 2014.
Grant Notice from European Appl. No. 13701525.1-1757, dated Nov. 24, 2014.
Preliminary Report on Patentability from PCT/US2013/035668, dated Oct. 14, 2014.
Office Action from U.S. Appl. No. 13/442,746, dated Sep. 15, 2014.
Office Action from U.S. Appl. No. 13/429,080, dated Sep. 16, 2014.
Office Action from U.S. Appl. No. 13/844,431, dated Oct. 10, 2014.
Office Action from U.S. Appl. No. 13/443,630, dated Oct. 10, 2014.
Office Action from U.S. Appl. No. 12/961,385, dated Nov. 6, 2014.
Office Action from U.S. Appl. No. 13/453,924, dated Nov. 7, 2014.
Notice of Completion of Pretrial Re-examination from Japanese Patent appl. No. 2013-543207, dated Jun. 30, 2015.
Pretrial Report from Japanese Appl. No. 2013-543207, dated Jun. 19, 2015.
Decision of Rejection from Chinese Patent Appl. No. 201180052998.4, dated Jul. 16, 2015.
Office Action from U.S. Appl. No. 12/873,303, dated Jun. 22, 2015.
Response to OA from U.S. Appl. No. 12/873,303, filed Aug. 21, 2015.
Office Action from U.S. Appl. No. 13/341,741, dated Jun. 22, 2015.
Office Action from U.S. Appl. No. 13/443,630, dated Jun. 23, 2015.
Response to OA from U.S. Appl. No. 13/443,630, filed Aug. 21, 2015.
Office Action from U.S. Appl. No. 13/189,535, dated Jul. 14, 2015.
Office Action from U.S. Appl. No. 13/453,924, dated Jul. 21, 2015.
Office Action from U.S. Appl. No. 13/442,746, dated Jul. 27, 2015.
Office Action from U.S. Appl. No. 14/020,757, dated Aug. 3, 2015.
First Office Action from Chinese Patent Appl. No. 2012800369142, dated Mar. 26, 2015.
Office Action from U.S. Appl. No. 13/464,745, dated Apr. 2, 2015.
Office Action from U.S. Appl. No. 13/442,746, dated Apr. 28, 2015.
Office Action from U.S. Appl. No. 13/828,348, dated May 27, 2015.
Office Action from U.S. Appl. No. 13/429,080, dated Sep. 1, 2015.
Office Action from U.S. Appl. No. 14/716,480, dated Sep. 24, 2015.
Office Action from U.S. Appl. No. 14/170,627, dated Oct. 5, 2015.
Office Action from U.S. Appl. No. 13/464,745, dated Oct. 8, 2015.
Office Action from U.S. Appl. No. 29/466,391, dated Oct. 14, 2015.
Office Action from U.S. Appl. No. 12/961,385, dated Nov. 27, 2015.
Office Action from U.S. Appl. No. 13/828,348, dated Nov. 4, 2015.
Office Action from U.S. Appl. No. 14/020,757, dated Nov. 24, 2014.
First Office Action from Chinese Patent Appl. No. 2011800588770, dated Sep. 25, 2015.
Office Action for U.S. Appl. No. 13/828,348; Dated Jun. 2, 2016.
Notice of Reason for Rejection for Japanese Appl. No. 20131432C7; Dated May 24, 2016.
Office Action for U.S. Appl. No. 14/020,757; Dated Jul. 19, 2016.
Examination Report from Taiwan Application No. 100131021; Dated Jul. 21, 2016.
Office Action for U.S. Appl. No. 14/716,480; Dated Aug. 26, 2016.
European Summons for Oral Proceedings for Application No. 12743003.1; Dated Sep. 2, 2016.
Office Action for U.S. Appl. No. 13/464,745; Dated Sep. 7, 2016.
Examination Report from Taiwanese Patent Appl. No. 100131021, dated Jan. 5, 2016.
Examination from European Patent Appl. No. 12743003.1-1757, dated Jan. 8, 2016.
Notice of Reasons for Rejection from Japanese Patent Appl. No. 2013-543207, dated Feb. 2, 2016.
Office Action from U.S. Appl. No. 13/189,535; Jan. 6, 2016.
Office Action from U.S. Appl. No. 13/341,741; Jan. 8, 2016.
Office Action from U.S. Appl. No. 13/873,303; Feb. 2, 2016.
Office Action from U.S. Appl. No. 13/464,745; Mar. 1, 2016.
Office Action from U.S. Appl. No. 14/716,480; Mar. 3, 2016.
Office Action from U.S. Appl. No. 13/189,535; Mar. 18, 2016.
Office Action from U.S. Appl. No. 14/020,757; Apr. 7, 2016.
Office Action from U.S. Appl. No. 29/466,391; May 10, 2016.
Second Office Action for Application No. 2011800558770; Dated Mar. 29, 2016.
Office Action for U.S. Appl. No. 14/225,327; dated Mar. 14, 2017.
European Notice of Allowance for Application No. 12743003.1; dated Mar. 17, 2017.
Office Action for U.S. Appl. No. 13/189,535; dated Mar. 23, 2017.
Office Action for U.S. Appl. No. 13/464,745; dated Mar. 23, 2017.
Foreign Office Action for Chinese Application No. 2011800529984; dated Apr. 5, 2017.
Office Action for U.S. Appl. No. 14/721,806; dated Apr. 21, 2017.
Office Action for U.S. Appl. No. 13/443,630; dated May 18, 2017.
Office Action for U.S. Appl. No. 14/170,627; dated Jun. 16, 2017.
Office Action for U.S. Appl. No. 14/716,480; dated Jul. 5, 2017.

* cited by examiner

FIG. 12
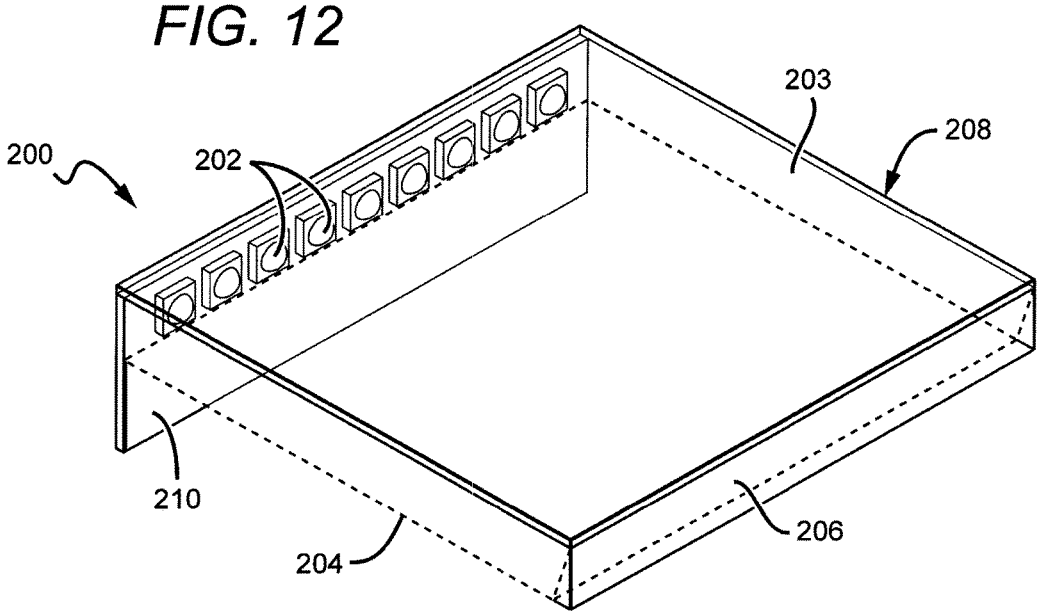
FIG. 13
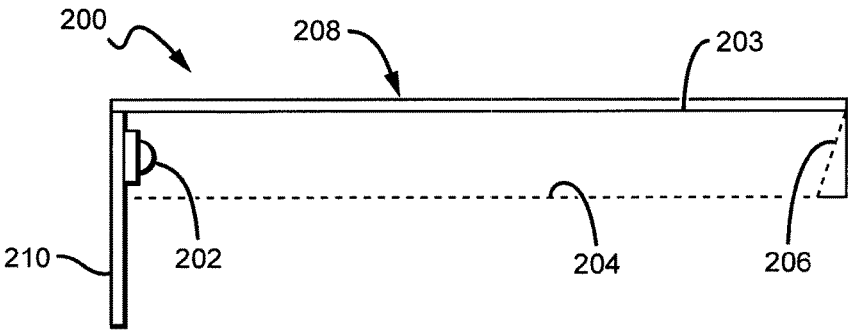
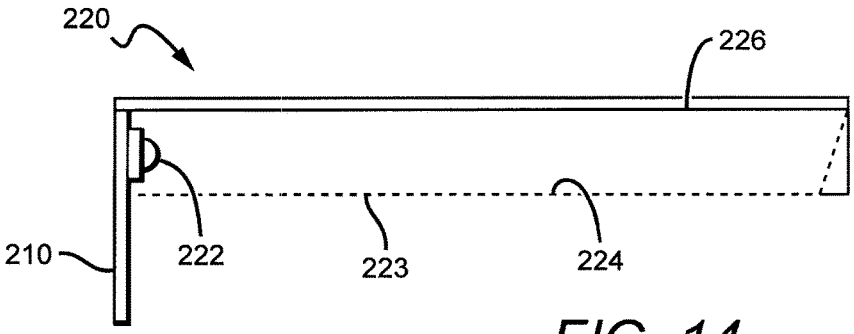
FIG. 14

MULTIPLE PANEL TROFFER-STYLE FIXTURE

BACKGROUND OF THE INVENTION

Field of the Invention

The invention relates to troffer-style lighting fixtures, and more particularly, to troffer-style lighting fixtures utilizing multiple solid state lighting panels.

Description of the Related Art

Troffer-style fixtures are ubiquitous in commercial office and industrial spaces throughout the world. In many instances these troffers house elongated fluorescent light bulbs that span the length of the troffer. Troffers may be mounted to or suspended from ceilings, such as being suspended by a "T-grid". Often the troffer may be recessed into the ceiling, with the back side of the troffer (i.e. troffer pan) protruding into the plenum area above the ceiling a distance of up to six inches or more. This can result in the troffer pan consuming a significant space in the ceiling plenum. In other arrangements, elements of the troffer on the back side dissipate heat generated by the light source into the plenum where air can be circulated to facilitate the cooling mechanism. U.S. Pat. No. 5,823,663 to Bell, et al. and U.S. Pat. No. 6,210,025 to Schmidt, et al. are examples of typical troffer-style fixtures. These fixtures can require a significant amount of ceiling space to operate properly.

More recently, with the advent of the efficient solid state lighting sources, these troffers have been used with solid state light sources, such as light emitting diodes (LEDs). LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color emission. In comparison, LEDs can have lifetimes between 50,000 and 70,000 hours. The increased efficiency and extended lifetime of LEDs is attractive to many lighting suppliers and has resulted in LED light sources being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

LED components or lamps have been developed that comprise an array of multiple LED packages mounted to a (PCB), substrate or submount. The array of LED packages can comprise groups of LED packages emitting different colors, and specular reflector systems to reflect light emitted by the LED chips. Some of these LED components are arranged to produce a white light combination of the light emitted by the different LED chips.

In order to generate a desired output color, it is sometimes necessary to mix colors of light which are more easily produced using common semiconductor systems. Because of the physical arrangement of the various source elements, multicolor sources often cast shadows with color separation and provide an output with poor color uniformity. Thus, one challenge associated with multicolor light sources is good spatial color mixing over the entire range of viewing angles. One known approach to the problem of color mixing is to use a diffuser to scatter light from the various sources.

Many current luminaire designs utilize forward-facing LED components with a specular reflector disposed behind the LEDs. One design challenge associated with multi-source luminaires is blending the light from LED sources within the luminaire so that the individual sources are not visible to an observer. Heavily diffusive elements are also used to mix the color spectra from the various sources to achieve a uniform output color profile. To blend the sources and aid in color mixing, heavily diffusive exit windows have been used. However, transmission through such heavily diffusive materials causes significant optical loss.

Some recent designs have incorporated light sources or light engines utilizing an indirect lighting scheme in which the LEDs or other sources are aimed in a direction other than the intended emission direction. This may be done to encourage the light to interact with internal elements, such as diffusers, for example. One example of an indirect fixture can be found in U.S. Pat. No. 7,722,220 to Van de Ven which is commonly assigned with the present application.

SUMMARY OF THE INVENTION

The present invention is directed to lighting fixtures utilizing a plurality of light sources, or light engines, which are mounted together in a modular fashion in the light fixture opening. In some embodiments, the plurality of light sources can comprise lighting panels that together form the overall fixture light source. The present invention is particularly applicable to troffer-style lighting fixtures that can be arranged with a plurality of lighting panels arranged in the troffer opening to illuminate the space below the troffer. Embodiments of the present invention can also utilize solid state light sources for the lighting panels, with some embodiments utilizing LEDs.

One embodiment of a troffer-style lighting fixture according to the present invention comprises a plurality of lighting panels each having a solid state light source. A frame is included with each of the lighting panels mounted to the frame. A source of electrical power is also included with each of the lighting panels connected to the source of electrical power to cause the respective solid state light source to emit light. Each of the said panels emits a substantially uniform light from its emission surface.

Another embodiment of a light fixture according to the present invention comprises a plurality of lighting panels having a plurality of solid state light sources. Each of the panels emits light out a light fixture opening. The fixture further includes an AC/DC converter providing a first DC signal to the light panels. A plurality of DC/DC converters is included, each of which is on a respective one of the lighting panels and providing a second DC signal to the solid state light sources.

Still another embodiment of a light fixture according to the present invention comprises a plurality of lighting panels in a light fixture opening, with each of the lighting panels emitting a substantially uniform light across its emission surface. Each of the lighting panels are also emitting in substantially the same direction. A power distribution system (or power spine) is included, with each of the panels connected to the power spine.

These and other aspects and advantages of the invention will become apparent from the following detailed description and the accompanying drawings which illustrate by way of example the features of the invention.

BRIEF DESCRIPTION OF THE DRAWINGS

FIG. 12 is a perspective view of still another embodiment of a lighting panel according to the present invention;

FIG. 13 is a side view of the lighting panel shown in FIG. 12; and

FIG. 14 is a sectional view of another embodiment of a lighting panel according to the present invention.

DETAILED DESCRIPTION OF THE INVENTION

Figure 1:
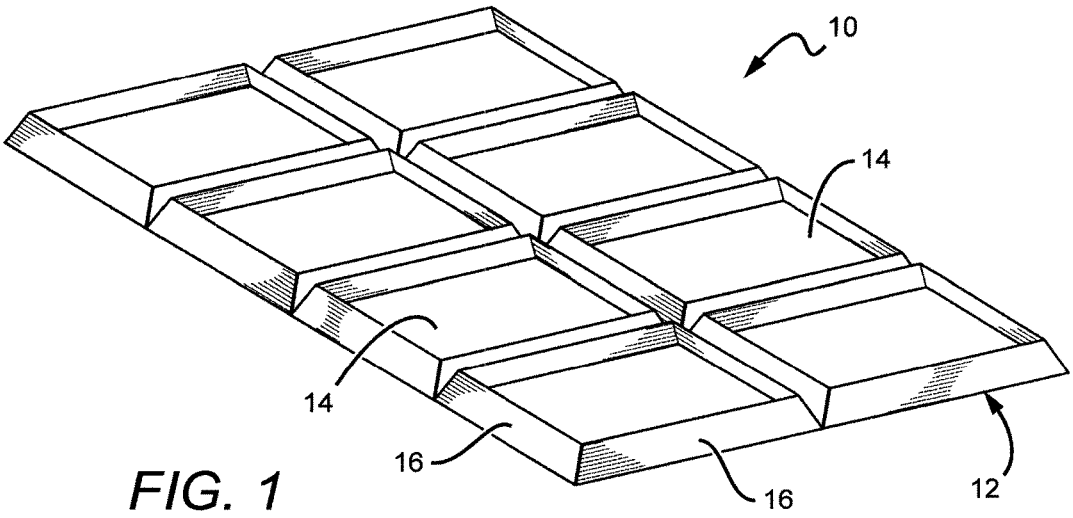
FIG. 1 is a top perspective view of one embodiment of a reflective frame that can be used in troffer-style lighting fixtures according to an embodiment of the present invention.

Embodiments of the present invention can be directed to many different light fixtures with the embodiments described herein directed to troffer-style fixtures that are particularly well-suited for use with solid state light sources, such as LEDs. The fixtures can comprise a plurality of lighting panels or light engines ("lighting panels" or "light panels"), each of which has a plurality of LEDs as its light source. In some embodiments, the panels can be arranged to provide a substantially even light source, such as white light, with the light from the LEDs dispersed or mixed so as to minimize or eliminate LED emission "hot spots". The panels can be mounted in a lighting fixture opening, such as a conventional troffer-style opening, with the panels mounted so that their emission illuminates the space below the troffer. In some embodiments, the panels can be mounted so that they are in the same plane. In other embodiments the lighting panels can be mounted in parallel planes, while in other embodiments the panels can be mounted at different angles to produce the desired light fixture emission pattern.

Some embodiments of the present invention can comprise components, such as panels and frames on and spanning across the ceiling T-grid opening. In some of these embodiments, the mounting or reflective frame can be located in and supported directly by the ceiling's T-grid, with the lighting panels then mounted to the reflective grid. In other embodiments, the lighting panels can be mounted directly in the T-grid opening without the need for a reflective frame. Embodiments of the present invention can be used without a troffer pan, with these embodiments consuming much less space in the ceiling area above the T-grid.

By using lighting panels in a modular approach, the present invention provides enhanced flexibility in lighting fixture design, installation and repair. The lighting fixtures according to the present invention can use different types of lighting panels that can be arranged in many different ways to provide a substantially uniform light emission from its emission surface. Some light panel embodiments can be arranged to be edge lit with a plurality of LEDs, and can comprise a waveguide to disperse the light from the LEDs to provide even emission across the panel. In still other embodiments, a lighting panel can be back lit with an array of LEDs emitting onto a diffuser panel that helps disperse the LED light. In still other embodiments, the panels can comprise indirect emission arrangements, wherein the panels can be edge lit with a plurality of LEDs that are arranged to emit onto a diffuser/reflector that mixes the light to provide an even emission. These are only a few of the different arrangements that can be used for the lighting panels, and in some embodiments the lighting fixtures can have the same types of panels, while in other lighting fixtures different types of lighting panels can be used in a particular fixture. Different numbers of panels can be used in different lighting fixtures, with the number of panels dependent upon a number of factors some of which include the size of the light fixture opening, the size of the lighting panels, and the mounting angles of the lighting panels.

In some embodiments the light fixture can use panels that are the same size, while in other embodiments the fixtures can use different sized lighting panels. In other embodiments, the panels can cover or fill the entire light fixture opening, while in other embodiments, the panels can cover or fill less than the entire lighting fixture opening.

Some conventional LED based troffer-style fixtures can comprise a light engine arranged with an array of LEDs, reflectors/diffuser, and power supply or ballast. For some of these, failure of one or more of the components can require replacement of the entire light fixture or light engine. In some light fixture embodiments according to the present invention, each lighting panel can have its own electrical connection to the lighting fixture, with each panel being removable and replaceable. This arrangement allows for one of the panels to be replaced in case of failure or malfunction of the panel's LEDs or power supply. This helps avoid the expense and inconvenience of removing the entire light fixture and/or its light engine. The failure can be localized to one particular panel, resulting in quick, convenient and cost-effective light fixture repair. Many different electrical connection arrangements can be used, that can be provided in many different locations in the light fixture opening. In some embodiments, a power connection spine can be included in the lighting fixture that carries a light fixture power signal, and is arranged so that each of the panels can easily connect to the spine for power. In some embodiments, the power connection spine can run down one of the surfaces of the light fixture's reflective frame, such as a longitudinal surface of the frame.

Some conventional LED based troffer-style light fixtures can also comprise power supply or ballast can also comprise various components and circuitry to dirve the fixture's light engine. Some of these can include an AC/DC converter and one or more DC/DC converters. These types of power supplies drive the entire light engine and as a result can comprise large and costly components. Furthermore, they can require setting of the output drive signal to provide the desired light engine light emission, with this setting typically done at the factory during light engine fabrication. If the ballast or power supply fails after installation, it can be difficult to replace and set in the field and in some instances the entire troffer or light engine needs to be replaced.

The light fixtures according to the present invention can have different power supply arrangements to convert conventional AC power to a DC power signal appropriate to drive the LEDs in the lighting panels. The power supplies also comprise other electrical components to perform other functions, such as current compensation circuitry to compensate for variations in LED emission in response to temperature changes or over time or dimming circuitry. In some embodiments, the lighting fixtures can comprise one AC/DC power supply that converts conventional AC power supplied to a home or office, to a DC drive signal. Each of the panels can then comprise its own DC/DC power supply that converts the DC drive signal to a level to provide the desired emission from that panel. In some embodiments, the compensation circuitry can also be located at each of the panels to compensate for emission changes locally, at the respective panel. As further described below, this power supply arrangement can reduce or eliminate many of the shortcomings associated with having a single overall power supply for the light fixture.

The panels according to the present invention can have many different shapes and sizes, with some embodiments being relatively thin, and having square or rectangular shapes. It is understood that other embodiments can have other shapes with many different numbers of sides, such as triangular, polygon, pentagon, hexagon, octagon, etc., while in other embodiments the panels can be oval or circular. As mentioned above, conventional troffer style light fixtures come in different sizes, and some embodiments of the panels can be sized such that different numbers of panels can be used to fill the different sized ceiling or troffer openings. For example, the panels can be sized and shaped such that a certain number of panels can be used to fill a 2 foot by 4 foot troffer opening, while a different number of lighting panels can be used to fill a 1 foot by 4 foot, or 2 foot by 2 foot troffer opening. Being able to use the same lighting panels in different sized openings provides flexibility in installing the light fixtures, and does not require the manufacturer, retailer, distributor or installer to supply or stock different sized troffers for these different applications.

The invention is described herein with reference to certain embodiments, but it is understood that the invention can be embodied in many different forms and should not be construed as limited to the embodiments set forth herein. In particular, the present invention is described below in regards to troffer-style light fixtures, but it is understood that it is applicable to many other lighting styles, types and applications. The embodiments are also described with reference to certain lighting panels, but it is understood that many different lighting panels can be used that are arranged in many different ways. The components can have different shapes and sizes beyond those shown and different numbers of LEDs or LED chips can be included. Many different commercially available LEDs can be used in the lighting panels according to the present invention such as those commercially available from Cree, Inc. These can include, but not limited to Cree's XLamp® XP-E LEDs or XLamp® XP-G LEDs.

It is understood that when an element is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "source" can be used to indicate a single light emitter or more than one light emitter functioning as a single source. Thus, the term "source" should not be construed as a limitation indicating either a single-element or a multi-element configuration unless clearly stated otherwise. For example, the lighting panels described herein as having a solid state light source, can have a single-element or multi-element configuration.

Embodiments of the invention are described herein with reference to cross-sectional view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of a device and are not intended to limit the scope of the invention.

Figure 2:
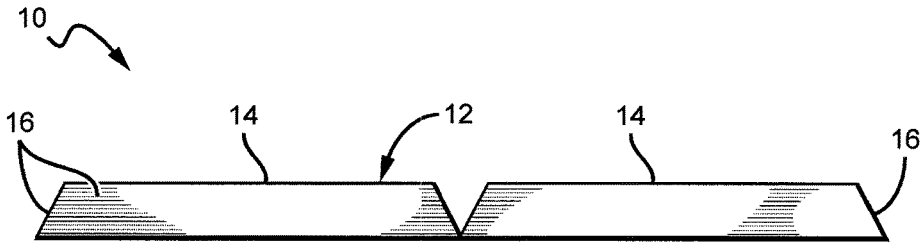
FIG. 2 is a side view of the reflective frame shown in FIG. 1.
Figure 3:
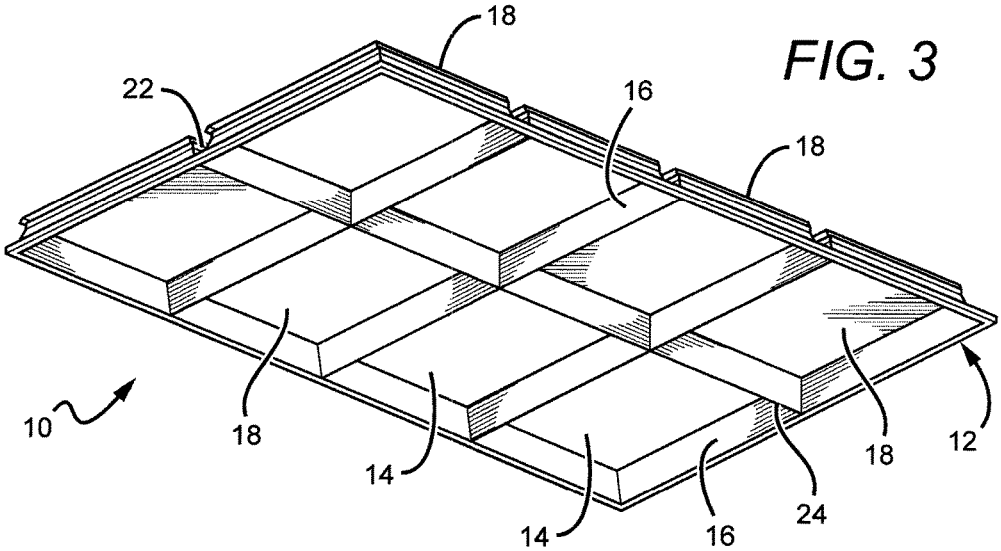
FIG. 3 is a bottom perspective view of one embodiment of a troffer-style lighting fixture according to the present invention.
Figure 4:
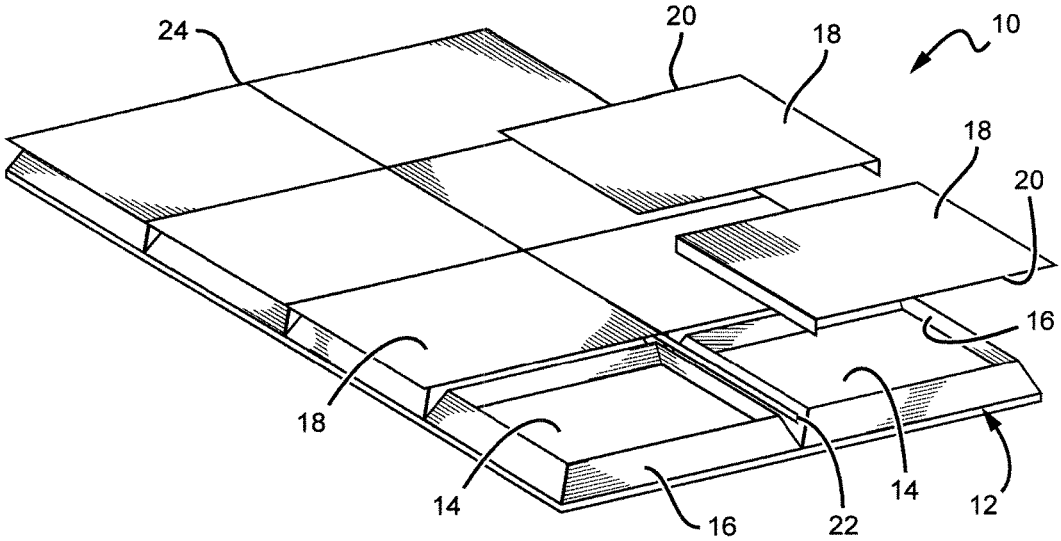
FIG. 4 is a top perspective view of the troffer-style lighting fixture shown in FIG. 3.

FIGS. 1 through 4 show one embodiment of a troffer-style light fixture 10 according to the present invention, with FIGS. 1 and 2 showing only the fixture's frame 12, and FIGS. 3 and 4 showing lighting panels 18 mounted to the frame 12. The fixture 10 can be used in many different applications but in the embodiment shown is sized to fit in an opening in a conventional T-grid ceiling. The frame 12 can be made of many different materials, and in some embodiments can comprise reflective surfaces, but it is understood that some or all of the surfaces of the frame can be non-reflective. The frame 12 is arranged in a grid that divides the troffer fixture 10 opening into a plurality of light panel openings 14. The frame 12 can comprise reflective surfaces 16 that are arranged to reflect light from light panels to illuminate the space below the panels. The frame 12 can have many different shapes and sizes and can comprise planar or curved reflective surfaces 16. The frame 12 can be made of many different materials, with a preferred material being heat conductive, such as a metal, to help in conducting and dissipating heat away from the lighting panels. The reflective surfaces 16 can comprise specular reflectors or diffuse reflectors. The frame 12 can be mounted in a ceiling T-grid opening in many different ways and in some embodiments one edge of the reflective frame can be mounted to the T-grid by a hinge. This allows for the frame to be rotated out of the T-grid opening about the hinge, to allow access to the elements of the troffer fixture 10 from the room below.

Referring now to FIGS. 3 and 4, the fixture 10 also comprises a plurality of lighting panels 18, with FIG. 4 showing two panels 18 removed from their respective one of the panel openings 14. Each of the panels 18 is quadrilaterally shaped and is sized to cover its panel opening 14, with light from each of the panels emitting through its opening 14 to the space below the fixture 10. As an example, the panels 18 can be squares and/or rectangles. As mentioned above, each of the panels can have different shapes and sizes, but in the embodiment shown each of the panels 18 are the same size. Each panel 18 also comprises a plurality of LEDs that can be arranged in the different ways mentioned above to provide an even emission from the panel. In the embodiment shown panels 18 are edge lit with a plurality of LEDs in a row emitting into a waveguide 20 to disperse the light from the LEDs.

The troffer-style fixture 10 can also comprise a system or mechanism to distribute electrical power to the panels 18. In the embodiment shown, a DC signal from an AC/DC converter (described in more detail below) is distributed to the various lighting panels. The DC signal can be distributed in many different ways, such as through a wiring harness or through printed circuit boards (PCBs). The wiring harness or PCBs can run along different portions of the fixture and can have a connector arrangement for connecting to the electrical power to the lighting panels 18.

Figure 5:
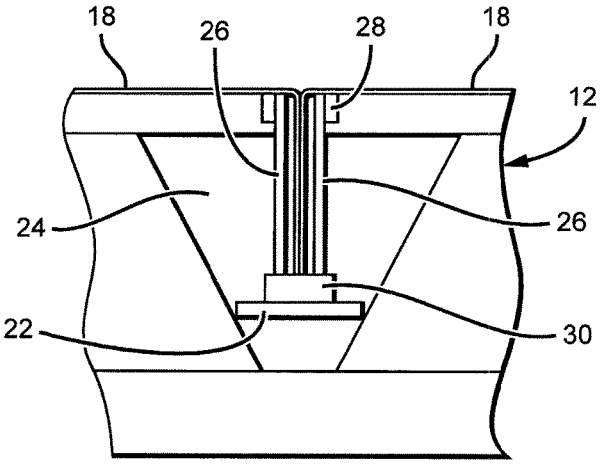
FIG. 5 is a side view of the central spine in one embodiment of a troffer-style lighting fixture according to the present invention.
Figure 6:
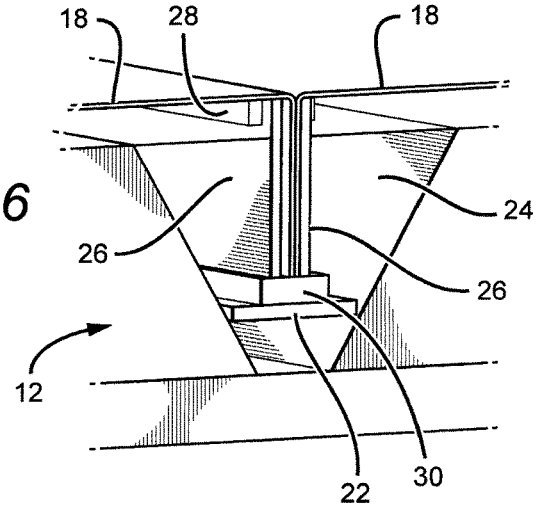
FIG. 6 is a perspective view of the central spine shown in FIG. 5.

In the embodiment shown, the power distribution system or mechanism can comprise a fixture PCB 22 (or multiple PCBs) running down central spine 24 (i.e. power spine) of the frame 12. It is understood, however, that a wiring harness can also be used running along the central spine. FIGS. 5 and 6 show one embodiment of the central spine 24 in greater detail, with the fixture PCB 22 arranged within the spine 24 and comprising conductors to carry the DC signal, and connectors allowing each lighting panel 18 to be electrically connected to the fixture PCB 22 for electrical power. Many different connection mechanisms/arrangements can be used, and in the embodiment shown each lighting panel 18 has an LED PCB 26 that is arranged generally at a right angle to the remainder of the panel 18, and holds the light panel's LEDs 28 and the panel's power converter (not shown). The fixture PCB 22 comprises a connector 30 arranged so that the LED PCB 26 can plug into the connector 30 to provide electrical connection between the two. This allows the power signal being carried on the fixture PCB 22 to be conducted to the LED PCB 26, which also comprises conductors to conduct the electrical signal to its power converter and on to the LEDs 28.

Referring again to FIGS. 1 through 4, the lighting panels 18 can be mounted to the frame 12 using many different materials or mechanisms, with the preferred material or mechanism allowing for the lighting panels 18 to be removed from the frame 12. This allows for the panels to be removed and replaced, such as in the case of replacing a malfunctioning or failed lighting panel. In some embodiments, removable brackets or clips can be used, but these are only two examples of the many mechanisms that can be used.

Figure 7:
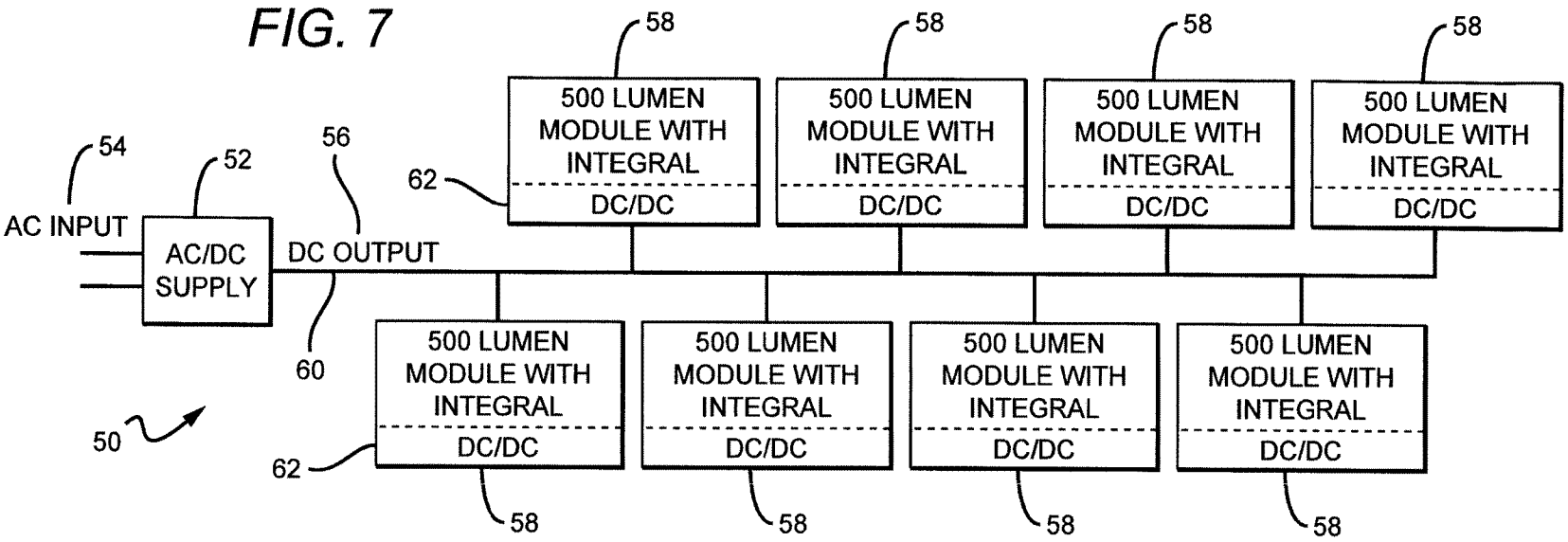
FIG. 7 is a block diagram of the electrical connections for one embodiment of a troffer-style lighting fixture according to the present invention.

Power can be supplied to the lighting fixture 10 using many different power supply, ballast and circuits arranged to provide the desired drive signal for illuminating the LEDs in its lighting panels. FIG. 7 is a block diagram showing one embodiment of power supply system 50 that can be used in lighting fixtures according to the present invention. In this embodiment an AC/DC power supply 52 converts conventional AC input power 54 (e.g. such as 120 volts AC) to a DC output 56 that is conducted to each of the lighting panels 58 along DC signal bus 60. Each lighting panel 58 can have its own on-board integral DC/DC converter 62 that converts signal from the DC output 56 to the appropriate DC level to drive the LEDs on each respective lighting panel 58. In some embodiments, on-board DC/DC converter can be on the fixture PCB 22 as shown in FIGS. 3 and 4. Each of the DC/DC converters 62 can have additional circuitry to provide other functions, such as compensating and dimming circuitry as mentioned above. These are only a couple of the many functions that can be provided along with the DC/DC converter 62.

Having respective DC/DC converters at each lighting panel can provide certain advantages. In conventional troffers having the AC/DC and DC/DC converters in one power supply can require setting of the output of the power supply at the factory to match it to the light engine of the particular troffer. Thus, if this type of combined power supply malfunctions or fails it can result in complex repair procedures or replacement of the entire troffer or light engine. By having the DC/DC converter integral to each lighting panel, the AC/DC converter does not need to be set at the factory. A failed or malfunctioning AC/DC converter can be easily replaced in the field. If an on-board DC/DC converter malfunctions or fails at the lighting panel, the entire lighting panel can be easily removed and replaced with a another functioning lighting panel. The DC/DC converter on the panel will have been set to the desired level for that particular panel, so the repair procedure does not require resetting in the field.

Furthermore, the components for a combined AC/DC and DC/DC converters that drive the entire fixture can also be large and expensive. By making the DC/DC converter on-board and remote at each of the lighting panels, smaller and less expensive components can be used because of the reduced power needed from each converter. A DC/DC converter for the entire fixture would need to accommodate 40 watts of power, or more. By dividing that load into multiple portions or panels (e.g. eight panels), the individual panels need only see 5 watts. This allows for many of the DC/DC circuit components to be consolidated into purpose-build integrated circuits, reducing cost and size. The remote DC/DC converters can also be arranged closer to the LEDs on each lighting panel which can provide for greater driving efficiency and control.

The lighting panels can be arranged to emit relatively even emission with different luminous flux, with some embodiments emitting at least 100 lumens, while other embodiments can emit at least 200 lumens. In still other embodiments the lighting panels can be arranged to emit at least 500 lumens, with the lighting panels in the embodiment shown emitting approximately 500 lumens each.

In some embodiments, each of the lighting panels in a particular fixture can emit light with the same characteristics, such as emission intensity, color temperature, and color rendering index. This can result in the particular fixture emitting a substantially uniform emission across its opening. The panels can be arranged with LEDs that can generate different colors of light, with the many industrial, commercial, and residential applications calling for fixtures emitting white lights. The lighting panels according to the present invention may comprise one or more emitters producing the same color of light or different colors of light. In some embodiments, a multicolor source is used to produce white light, and several colored light combinations can be used to yield white light. For example, as discussed in U.S. Pat. Nos. 7,213,940 and 7,768,192, both of which are assigned to Cree, Inc., and both of which are incorporated herein by reference, it is known in the art to combine light from a blue LED with wavelength-converted yellow light to yield white light with correlated color temperature (CCT) in the range between 5000K to 7000K (often designated as "cool white"). Both blue and yellow light can be generated with a blue emitter by surrounding the emitter with phosphors that are optically responsive to the blue light. When excited, the phosphors emit yellow light which then combines with the blue light to make white. In this scheme, because the blue light is emitted in a narrow spectral range it is called saturated light. The yellow light is emitted in a much broader spectral range and, thus, is called unsaturated light.

Another example of generating white light with a multicolor source is combining the light from green and red LEDs. RGB schemes may also be used to generate various colors of light. In some applications, an amber emitter is added for an RGBA combination. The previous combinations are exemplary; it is understood that many different color combinations may be used in embodiments of the present invention. Several of these possible color combinations are discussed in detail in U.S. Pat. No. 7,213,940 to Van de Ven et al.

Other lighting panel embodiments can utilize a series of clusters having two blue-shifted-yellow LEDs ("BSY") and a single red LED ("R"). BSY refers to a color created when blue LED light is wavelength-converted by a yellow phosphor. The resulting output is a yellow-green color that lies off the black body curve. BSY and red light, when properly mixed, combine to yield light having a "warm white" appearance. These and other color combinations are described in detail in the previously incorporated patents to Van de Ven (U.S. Pat. Nos. 7,213,940 and 7,768,192). The lighting panels according to the present invention can use a series of clusters having two BSY LEDs and two red LEDs that can yield a warm white output when sufficiently mixed.

Figure 9:
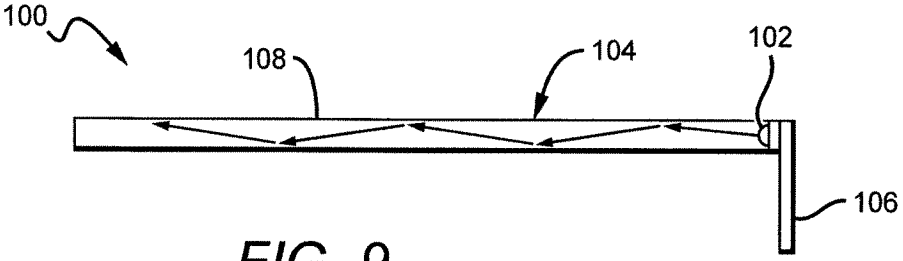
FIG. 9 is a sectional view of the lighting panel shown in FIG. 8.
Figure 8:
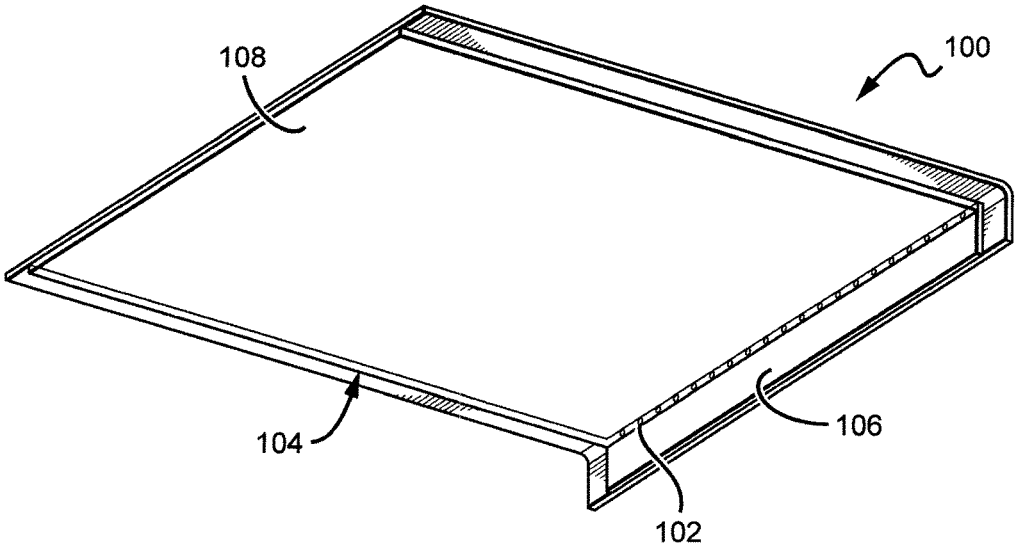
FIG. 8 is a perspective view of one embodiment of a lighting panel according to the present invention.

FIGS. 8 and 9 show one embodiment of lighting panel 100 according to the present invention that comprises an array of LEDs 102 mounted to an edge of a light waveguide 104 so that light from the LEDs enters the waveguide 104. In the embodiment shown the LEDs 102 are mounted to an LED PCB 106 as discussed above, with the LED PCB 106 mounted to an edge of the waveguide 104 with emission from the LEDs directed down the waveguide 104. Many different waveguides can be used, with waveguides being generally known in the art and are only briefly discussed herein. The waveguide 104 can comprise many different light transmitting materials, such as glass or different plastics, with the waveguide 104 confining LED light between its surfaces. This results in the LED light mixing and dispersing within the waveguide 104. In the areas where it is desired to have light escape from the waveguide, such as through the emission surface 108, the planar nature of the surface can be interrupted. These interruptions can include many different features, such as cuts or indents, and to provide a uniform panel emission pattern, different concentrations and sizes of interruptions can be included in different areas of the emission surface. In some embodiments, there can be a higher concentration and/or larger interruptions moving further away from the LEDs. This is also referred to as a controlled gradient profile.

One advantage of a waveguide lighting panel embodiment is that they can be relatively thin, thereby consuming much less space in the ceiling. Different embodiments can have different thicknesses, with some being less than 25 mm thick. Other embodiments can be less than 10 mm thick. The embodiment shown can have a thickness of approximately 6 mm. The panels can also have different sizes, with some panels according to the present invention sized so that they can be used in different sized troffer openings. In the embodiment shown, the panel 100 can be square, with each edge being an approximately 1 foot long. This allows for eight panels to fill a 2 foot by 4 foot troffer opening fixture as shown in FIGS. 1-4. Different panels can have different sizes, such a square with 6 inch sides or a square with 2 foot sides. While in other embodiments the panels can be rectangular with sides having different lengths.

Figure 10:
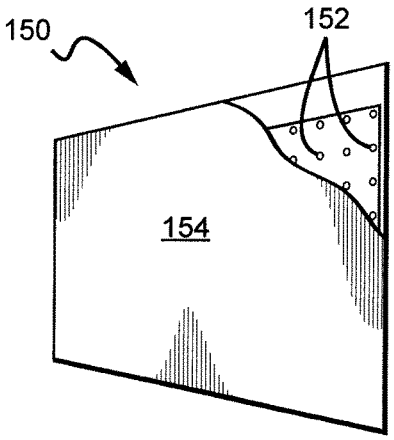
FIG. 10 is a perspective view of another embodiment of a lighting panel according to the present invention.
Figure 11:
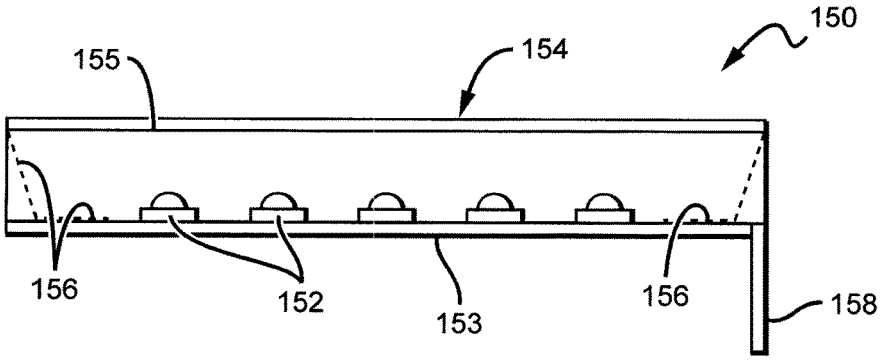
FIG. 11 is a sectional view of the lighting panel shown in FIG. 10.

FIGS. 10 and 11 show another embodiment of lighting panel 150 according to the present invention that also comprises a plurality of LEDs 152 but in this embodiment the LEDs 152 are arranged on the panel's back surface 153. The LEDs are arranged to emit light directly on the panel's emission surface 154 in a "backlight" arrangement. In some embodiments, the LEDs 152 can be evenly spaced and can comprise optics to provide an LED emission pattern that minimizes the visible bright spots. The emission surface 154 can also comprise a diffuser 155 to mix the light to further minimize bright spots. The interior surface of the lighting panel 150 can also comprise a diffuse or reflective coating/layer 156 to help reflect and disperse light from the LEDs. In some embodiments, the layer 156 can comprise a white diffusive material such as a microcellular polyethylene terephthalate (MCPET) material or a commercially available Dupont/WhiteOptics material, for example. Other white diffuse reflective materials can also be used.

Diffuse reflective coatings have the inherent capability to mix light from solid state light sources having different spectra (i.e., different colors). These coatings are particularly well-suited for multi-source designs where two different spectra are mixed to produce a desired output color point. A diffuse reflective coating may reduce or eliminate the need for additional spatial color-mixing schemes that can introduce lossy elements into the system; although, in some embodiments it may be desirable to use diffuse reflectors in combination with other diffusive elements. In some embodiments, the surfaces can also be coated with a phosphor material that converts the wavelength of at least some of the light from the light emitting diodes to achieve a light output of the desired color point.

In other embodiments the coating/layer 156 can comprise materials other than diffuse reflectors. In other embodiments, the coating/layer can comprise a specular reflective material or a material that is partially diffuse reflective and partially specular reflective. In some embodiments, it may be desirable to use a specular material in one area and a diffuse material in another area. These are only some of the many combinations are possible.

Like the embodiment above, the lighting panel also has a PCB 158 that can be arranged for connecting to electrical power and can have a DC/DC conversion circuit as discussed above. In this lighting panel embodiment, however, the LEDs 152 reside on the back surface 153 of the lighting panel 150, with the PCB 158 having conductors to transmit a drive signal to the LEDs 152. The PCB 158 is arranged generally at a right angle to the remainder of the lighting panel 150 for connection to electrical power at the central spine 24 (shown in FIGS. 5 and 6). The lighting panel 150 can have different thicknesses, with some embodiments being less than 50 mm thick. In other embodiments, the lighting panel can have a thickness in the range of 10-25 mm.

FIGS. 12 and 13 show another embodiment of a lighting panel 200 according to the present invention that comprises an array of LEDs 202 along one edge of the lighting panel 200. In this embodiment, however, the emission from the LEDs 202 is not directed down a waveguide, and is not directed on the panel's emission surface 203. Instead, the LEDs 202 are arranged in such a way that allows for their emission from the panel's edge to cover or "paint" the panel's bottom surface 204. The panel's side surface 206 can be angled, with the bottom surface 204 and side surface 206 comprising a specular reflector that reflects light from the LEDs toward and through a diffuser 208. The combination of painting the panel's bottom surface 204, reflecting the light, and passing the light through a diffuser 208, can result in relatively even emission from the panel 200. The LED emission pattern necessary for painting of the bottom surface 204 can be provided by use of optics and/or by angling the LEDs to direct emission toward the bottom surface 204.

Like the embodiments above, the lighting panel 200 can comprise an LED PCB 210 holding the LEDs 202, and can also have a DC/DC power converter as described above. The lighting panel 200 can have different thicknesses, and like the embodiment above, some embodiments can be less than 50 mm thick. In other embodiments, the lighting panel can have a thickness in the range of 10-25 mm. The panel 200 can also have a square or rectangular shape of the different sizes mentioned FIG. 14 shows still another embodiment of a lighting panel 220 according to the present invention that is similar to the lighting panel 200 shown in FIGS. 11 and 12. The lighting panel 220 comprises an array of LEDs 222 along one edge of the panel, with emission from the LEDs covering or painting the panel's bottom surface 223. In this embodiment, however, the bottom surface does not comprise a specular reflector, but instead comprises a white diffusive coating/layer 224 such as a microcellular polyethylene terephthalate (MCPET) material or a commercially available Dupont/WhiteOptics material as described above. The LED emission on the coating/layer 224 creates a virtual light source on the panels bottom surface 223 that can then emit out of the panel's emission surface 226. The emission surface 226 can be covered by a layer of clear material that transmits the light from coating/layer 224, or can comprise a diffuser in those embodiments where further light mixing is desired.

Like the embodiments above, the lighting panel 200 can comprise a LED PCB :210 holding the LEDs 222, and can also have a DC/DC power converter as described above. The lighting panel 220 can have different thicknesses, with some embodiments being less than 50 mm thick. In other embodiments, the lighting panel can have a thickness in the range of 10-25 mm, and can be one of the shapes or sizes mentioned above.

It is understood that embodiments presented herein are meant to be exemplary. Embodiments of the present invention can comprise any combination of compatible features shown in the various figures, and these embodiments should not be limited to those expressly illustrated and discussed.

Although the present invention has been described in detail with reference to certain preferred configurations thereof, other versions are possible. Therefore, the spirit and scope of the invention should not be limited to the versions described above.

We claim:

1. A light fixture, comprising:

a plurality of lighting panels in a light fixture opening, each of said lighting panels emitting a substantially uniform light across its emission surface and emitting in substantially the same direction; and a power distribution system, each of said panels connected to said power distribution system, said power distribution system comprising a fixture printed circuit board (PCB) that extends along a central spine of said light fixture.

2. The light fixture of claim 1, wherein at least some of said lighting panels are removable.

3. The light fixture of claim 1, wherein at least some of said lighting panels are removable and replaceable.

4. The light fixture of claim 1, wherein said lighting panels are mounted in substantially the same plane.

5. The light fixture of claim 1, wherein said light fixture opening comprises a ceiling opening.

6. The light fixture of claim 1, wherein said light fixture opening comprises a troffer-style light fixture opening.

7. The light fixture of claim 1, wherein said lighting panels further comprise a solid state light source.

8. The light fixture of claim 1, wherein said panels further comprises light emitting diodes (LEDs) arranged to emit light through said emission surface.

9. The light fixture of claim 8, wherein one or more of said panels further comprises a waveguide, said panel's LEDs mounted along at least one edge of, and emitting light down its said waveguide.

10. The light fixture of claim 9, wherein a surface of said waveguide comprises a plurality of planar interruptions arranged to cause light to escape from said waveguide at said interruptions.

11. The light fixture of claim 10, wherein said interruptions comprise cuts or indents.

12. The light fixture of claim 10, comprising different concentrations or sizes of interruptions at different areas of said waveguide.

13. The light fixture of claim 10, wherein said interruptions comprise a controlled gradient profile.

14. The light fixture of claim 8, wherein said panels further comprise a back surface opposite said emission surface, wherein said LEDs are mounted to said back surface to emit light directly on said emission surface.

15. The light fixture of claim 14, wherein said emission surface comprises a diffuser.

16. The light fixture of claim 14 wherein portions of said back surface around said comprises a diffuse or reflective coating/layer.

17. The light fixture of claim 8, wherein said panels further comprise a back surface opposite said emission surface, and a plurality of LEDs along one edge of said panel and emitting light on said back surface.

18. The light fixture of claim 17, wherein said back surface comprises a specular reflector to reflect said LED light through said emission surface.

19. The light fixture of claim 17, wherein said back reflector comprises a diffuse layer to diffuse and reflect said LED light through said emission surface.

20. The light fixture of claim 19, wherein said diffuse layer comprises a virtual light source.

21. The light fixture of claim 1, further comprising a reflective frame, said light panels mounted to said reflective frame.

22. The light fixture of claim 21, wherein said power distribution system is mounted to said reflective frame.

23. The light fixture of claim 1, wherein said power distribution system comprises a power spine.

24. The light fixture of claim 1, wherein said power distribution system comprises a wiring harness.

25. The light fixture of claim 1, having an AC/DC converter.

26. The light fixture of claim 1, wherein each of said lighting panels comprises a DC/DC converter.

27. The light fixture of claim 1, wherein said lighting panels have the same size.

28. A troffer-style lighting fixture, comprising:

a plurality of lighting panels, each of said lighting panels comprising a solid state light source;

a frame, said lighting panels mounted to said frame;

a source of electrical power, each of said lighting panels electrically connected to said source of electrical power to cause said solid state light source to emit light;

a power spine comprising a fixture printed circuit board (PCB) running down the center of said frame, said power spine comprising connectors to receive each of said light panels and to provide an electrical connection between said source of electrical power and each of said light panels.

29. The lighting fixture of claim 28, sized to fit in the opening in a ceiling T-grid.

30. The lighting fixture of claim 28, wherein said frame comprises reflective surfaces.

31. The light fixture of claim 28, wherein said frame comprises curved surfaces.

32. The light fixture of claim 28, wherein said lighting panels are removably mounted to said frame.

33. A light fixture, comprising:

a plurality of lighting panels having a plurality of solid state light sources, said plurality of lighting panels emitting light out a light fixture opening;

an AC/DC converter providing a first DC signal along a central spine of said light fixture to each of said plurality of lighting panels; and a plurality of DC/DC converters, each of which is on a respective one of said lighting panels and providing a second DC signal to said solid state light sources.

34. The light fixture of claim 33, further comprising a power distribution mechanism to conduct said first DC signal to said lighting panels.

35. The light fixture of claim 33, wherein solid state light sources comprise light emitting diodes (LEDs).

36. The light fixture of claim 33, sized to fit in a T-grad ceiling opening.

37. The light fixture of claim 33, comprising a troffer-style light fixture.

38. The light fixture of claim 33, wherein said lighting panels are mounting in substantially the same plane.

39. The light fixture of claim 35, wherein each of said lighting panels has an emission surface, and wherein one or more of said panels further comprising a waveguide, said panel's LEDs mounted along at least one edge of, and emitting light down its said waveguide and out said emission surface.

40. The light fixture of claim 35, wherein each of said lighting panels has an emission surface, and wherein one or more of said lighting panels further comprise a back surface opposite said emission surface, wherein said LEDs are mounted to said back surface to emit light directly on said emission surface.

41. The light fixture of claim 35, wherein each of said lighting panels has an emission surface wherein said panels further comprise a back surface opposite said emission surface, and a plurality of LEDs along one edge of said panel, said LED emitting light on said back surface.

42. The light fixture of claim 33, further comprising a reflective frame, said lighting panels mounted to said frame.

43. The light fixture of claim 42, further comprising a power spine mounted to said reflective frame.

44. A lighting fixture lighting panel, comprising:

a waveguide for confining LED light between its opposing planar surfaces, one of said planar surfaces being a panel emission surface;

an array of light emitting diodes (LEDs) mounted to an LED printed circuit board (PCB) on at least one edge of said waveguide and emitting light into said waveguide;

planar interruptions at different areas of said panel emission surface, wherein said planar interruptions provide a uniform emission pattern from the panel; and a DC/DC converter on said LED PCB to provide an electrical signal for driving said array of LEDs, wherein said LED PCB comprises conductors configured such that said LED PCB can be plugged into connectors on an external structure to secure said panel to said external structure and provide an electrical connection.

45. The lighting panel of claim 44, wherein said interruptions comprise cuts or indents.

46. The light fixture of claim 44, wherein said interruptions comprise different concentrations or sizes at different areas of said waveguide.

47. The light fixture of claim 44, wherein said interruptions comprise a controlled gradient profile.

48. The light fixture of claim 44, further comprising a connection for mounting in a T-grid ceiling opening.

* * * * *